US012781597B2

(12) United States Patent
Zhou et al.

(10) Patent No.: US 12,781,597 B2
(45) Date of Patent: Nov. 3, 2026

(54) ORGANIC ESTERS WITH ALKANYL GROUP FOR USE IN SUBTERRANEAN FORMATIONS

(71) Applicant: Halliburton Energy Services, Inc., Houston, TX (US)

(72) Inventors: Hui Zhou, Houston, TX (US); Sohini Bose, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/223,790

(22) Filed: May 30, 2025

(65) Prior Publication Data

US 2025/0290389 A1 Sep. 18, 2025

Related U.S. Application Data

(62) Division of application No. 17/918,788, filed as application No. PCT/US2022/015537 on Feb. 7, 2022, now abandoned.

(51) Int. Cl.
*E21B 37/06* (2006.01)
*E21B 43/27* (2006.01)

(52) U.S. Cl.
CPC ..... *E21B 37/06* (2013.01); *E21B 43/27* (2020.05)

(58) Field of Classification Search
None
See application file for complete search history.

(56) References Cited

U.S. PATENT DOCUMENTS

| | | | | |
|---|---|---|---|---|
| 6,710,019 | B1 * | 3/2004 | Sawdon | C09K 8/512 507/261 |
| 11,098,237 | B1 | 8/2021 | Zhou et al. | |
| 11,434,418 | B1 | 9/2022 | Zhou et al. | |
| 11,584,878 | B1 | 2/2023 | Yue et al. | |
| 2007/0169938 | A1 | 7/2007 | Moorehead et al. | |
| 2009/0286701 | A1 | 11/2009 | Davidson | |
| 2014/0069643 | A1 | 3/2014 | Ogle et al. | |
| 2014/0069644 | A1 | 3/2014 | Reddy et al. | |
| 2014/0311743 | A1 | 10/2014 | Vo et al. | |
| 2015/0369027 | A1 | 12/2015 | Jones et al. | |

(Continued)

FOREIGN PATENT DOCUMENTS

| | | | |
|---|---|---|---|
| WO | 2009074795 | A1 | 6/2009 |
| WO | 2015069261 | A1 | 5/2015 |
| WO | 2020231400 | A1 | 11/2020 |

OTHER PUBLICATIONS

International Search Report and Written Opinion for International Patent Application No. PCT/US2022/015537 dated Nov. 1, 2022. PDF file. 10 pages.

(Continued)

*Primary Examiner* — Andrew Sue-Ako
(74) *Attorney, Agent, or Firm* — Thomas Rooney; C. Tumey Law Group, PLLC

(57) ABSTRACT

Methods and compositions involving certain organic esters that release an organic acid for use in the subterranean formation are provided. In some embodiments, the methods include providing a treatment fluid including an aqueous base fluid and at least one organic ester comprising an alkynyl group or the like, and introducing the treatment fluid into at least a portion of a wellbore penetrating at least a portion of a subterranean formation.

20 Claims, 1 Drawing Sheet

(56) References Cited

U.S. PATENT DOCUMENTS

| | | | | |
|---|---|---|---|---|
| 2017/0183561 | A1 | 6/2017 | Ogle et al. | |
| 2017/0362499 | A1 | 12/2017 | Welton | |
| 2018/0291252 | A1 | 10/2018 | Zhou et al. | |
| 2020/0032135 | A1 | 1/2020 | Zhou et al. | |
| 2020/0224081 | A1 | 7/2020 | Peng et al. | |
| 2020/0270502 | A1* | 8/2020 | Reddy | C09K 8/62 |
| 2020/0291287 | A1* | 9/2020 | Purdy | C09K 8/54 |
| 2021/0115319 | A1 | 4/2021 | Santos et al. | |
| 2021/0115320 | A1 | 4/2021 | Santos et al. | |
| 2021/0371721 | A1 | 12/2021 | Zhou et al. | |
| 2023/0142443 | A1 | 5/2023 | Zhou et al. | |
| 2025/0043660 | A1 | 2/2025 | Zhou et al. | |

OTHER PUBLICATIONS

Non-Final Office Action for U.S. Appl. No. 17/918,788 dated Jan. 23, 2025. PDF file. 19 pages.

Egyptian Office Action for EG Patent Application No. 2023020175 dated Feb. 12, 2025. English Machine Translation with Original Untranslated Version, PDF file. 8 pages.

Final Office Action for U.S. Appl. No. 17/918,788 dated Apr. 4, 2025. PDF file. 12 pages.

Saudi Arabian Office Action for SA Patent Application No. 523450289 dated Jun. 28, 2025. English Machine Translation with Original Untranslated Version, PDF file. 18 pages.

* cited by examiner

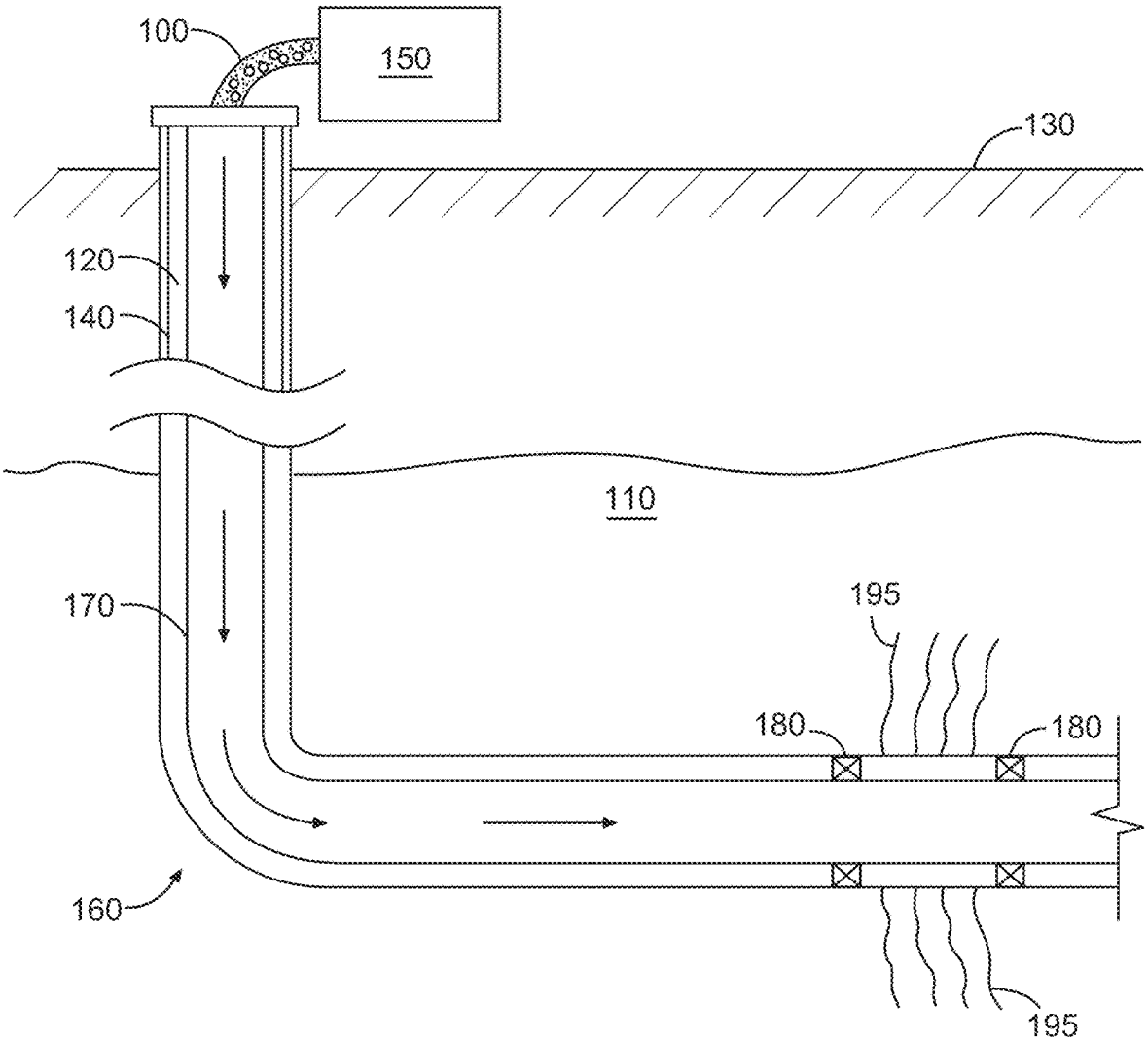
100
150
130
120
140
110
170
195
180
180
160
195

ORGANIC ESTERS WITH ALKANYL GROUP FOR USE IN SUBTERRANEAN FORMATIONS

CROSS REFERENCE TO RELATED APPLICATIONS

This is a divisional application of application Ser. No. 17/918,788, which is a national stage application, filed under 35 U.S.C. 371, of International Patent Application No. PCT/US2022/015537, filed Feb. 7, 2022, which are incorporated herein by reference in their entireties.

BACKGROUND

The present disclosure relates to methods and compositions for treating a subterranean formation.

Treatment fluids may be used in a variety of subterranean treatment operations. As used herein, the terms "treat," "treatment," "treating," and grammatical equivalents thereof refer to any subterranean operation that uses a fluid in conjunction with achieving a desired function and/or for a desired purpose. Use of these terms does not imply any particular action by the treatment fluid or a component thereof, unless otherwise specified herein.

Some common subterranean treatment operations that employ treatment fluids are acidizing operations. Illustrative acidizing operations may include, for example, matrix acidizing, acid fracturing, scale dissolution and removal, polymer breaking, filter cake dissolution, and the like. These acidizing operations may be used to accomplish a number of purposes. Such purposes may include increasing or restoring the permeability of subterranean formations so as to facilitate the flow of oil and gas from the formation into the well. Additionally, the acid treatments may also be used to remove acid soluble deposits or other substances in the formation (e.g., carbonates) along as much of the hydrocarbon flow path as possible and/or to create new flow paths as in matrix acidization.

Although acidizing a portion of a subterranean formation may be beneficial, conventional acidizing systems may have certain drawbacks. For example, one problem associated with conventional acidizing treatment systems is that deeper penetration into the formation is not usually achievable because, inter alia, the acid may be spent before it can deeply penetrate into the subterranean formation. Whatever the rate of reaction of the acidic solution, the solution can be introduced into the formation only a certain distance before it becomes spent. Certain delayed-release acid products have been used to allow acids to penetrate deeper into a formation before they are spent. However, most delayed-release acid products currently available for use in these applications release weak organic acids such as formic, acetic, glycolic, and lactic acid, which may have limited dissolving capacity for carbonates. As a result, large amounts of these weak acids may be needed to achieve the desired amount of carbonate dissolution. Such weak acids also may be ineffective in substantially breaking certain biopolymers such as xanthan gums and/or crosslinked starches, particularly at relatively low temperatures and/or when carbonates are also present.

BRIEF DESCRIPTION OF THE DRAWINGS

These drawings illustrate certain aspects of some of the embodiments of the present disclosure and should not be used to limit or define the claims.

FIG. 1 is a diagram illustrating an example of a subterranean formation in which a treatment fluid is introduced in accordance with certain embodiments of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

The present disclosure relates to methods and compositions for use in a subterranean formation. More particularly, the present disclosure relates to methods and compositions involving certain organic esters that release an organic acid for use in the subterranean formation.

The present disclosure provides compositions and methods that involve the use of additives and treatment fluids that include certain organic esters that include at least one electron withdrawing group ("EWG"). The present disclosure also provides methods that include providing a treatment fluid that includes an aqueous base fluid and at least one organic ester that includes at least one electron withdrawing group. The methods of the present disclosure may also include introducing the treatment fluid in a wellbore penetrating at least a portion of a subterranean formation. In some embodiments, the methods may further include allowing the organic ester(s) to release at least one organic acid in the subterranean formation. As used herein, the term "release" and grammatical variants thereof shall be understood to also include the terms "generate," "form," "create," and the like and grammatical variants thereof. In some embodiments, the methods may further include allowing the released acid to acidize the portion of the subterranean formation or damage contained therein. In some embodiments, the methods may further include contacting at least a portion of a biopolymer or a filter cake located in the subterranean formation with the released acid, wherein the portion of the biopolymer or the filter cake at least partially degrades.

Among the many potential advantages to the methods and compositions of the present disclosure, only some of which are alluded to herein, the methods and compositions of the present disclosure may include an additive that releases an acid in situ within a subterranean formation, which may avoid the acid becoming prematurely spent (e.g., by reacting with the formation itself, fines, other chemicals, metal surfaces within the formation, and/or undesirable deposits nearest the wellbore) before performing its desired purpose in a desire location within the formation. In certain embodiments, the release of the acid by the additive of the present disclosure may be delayed until the treatment fluid including it reaches a desired location within the subterranean formation. The acids released using the methods and additives of the present disclosure may have stronger acidity than organic acids typically released using certain ester-based breaker compositions known in the art. This may require less acid product to achieve similar results in breaker and/or acidizing applications. This also may allow the methods and compositions of the present disclosure to more effectively break certain types of polymers and viscosified fluids and/or polymers and viscosified fluids at lower temperatures as compared to certain other breaker compositions. This also may allow the methods and compositions of the present disclosure to more effectively dissolve carbonates present in a subterranean formation. Additionally, in some embodiments, the methods and compositions of the present disclosure may provide improved uniformity in placement of the acid in the subterranean formation.

In certain embodiments, the acid that is generated and/or released in accordance with the methods and compositions of the present disclosure may be used in any suitable acidizing treatment to acidize at least a portion of a subterranean formation or one or more deposits contained therein, such as deposits that may reduce permeability. As used herein, the term "deposits" includes, but is not limited to, filter cakes, biopolymers, synthetic polymers, hydrates, surfactants (including viscoelastic surfactants), bridging agents, scale deposits, skin deposits, and geological deposits. Furthermore, in some embodiments, the methods and compositions of the present disclosure may effectively generate wormholes to stimulate production in carbonate-bearing subterranean formations, dissolve damage, and remove fines to recover production in formations at elevated temperatures.

In certain embodiments, the methods of the present disclosure may include providing a treatment fluid that includes an aqueous base fluid and at least one organic ester of the chemical structures noted above. The treatment fluids prepared according to the methods and compositions of the present disclosure may include any aqueous base fluid known in the art. The term "base fluid" refers to the major component of the fluid (as opposed to components dissolved and/or suspended therein), and does not indicate any particular condition or property of that fluid such as its mass, amount, pH, etc. Aqueous fluids that may be suitable for use in the methods of the present disclosure may include water from any source. Such aqueous fluids may include fresh water, salt water (e.g., water containing one or more salts dissolved therein), brine (e.g., saturated salt water), seawater, or any combination thereof. In some embodiments of the present disclosure, the aqueous fluids include one or more ionic species, such as those formed by salts dissolved in water. For example, seawater and/or produced water may include a variety of divalent cationic species dissolved therein. In certain embodiments, the density of the aqueous fluid can be adjusted, among other purposes, to provide additional particulate transport and suspension in the methods of the present disclosure. In certain embodiments, the pH of the aqueous fluid may be adjusted (e.g., by a buffer or other pH adjusting agent) to a specific level, which may depend on, among other factors, the types of viscosifying agents, acids, and other additives included in the fluid. One of ordinary skill in the art, with the benefit of this disclosure, will recognize when such density and/or pH adjustments are appropriate.

The organic esters used in the compositions and methods of the present disclosure may be any organic ester that includes at least one electron withdrawing group selected from the group consisting of F, Cl, Br, I, $NO_2$, a vinyl group, an acetylenic group, an aromatic group, a carbonyl group, an alkoxyl group, a cyano functional group (C≡N), or any derivative thereof. In some embodiments, such organic esters may be referred to as "electron-poor organic esters". In some embodiments, at least one of the electron withdrawing groups may be present in the organic ester at the α-position relative to an carboxylic acid group therein. In certain embodiments, the organic esters used in the compositions and methods of the present disclosure may be any organic ester having one of the following chemical structures:

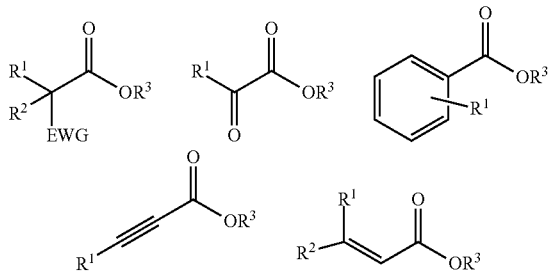

wherein EWG is selected from the group consisting of F, Cl, Br, I, $NO_2$, a vinyl group, an acetylenic group, an aromatic group, a carbonyl group, an alkoxyl group, a cyano functional group (C≡N), or any derivative thereof; $R^1$ and $R^2$ are each independently selected from the group consisting of F, Cl, Br, I, $NO_2$, a vinyl group, an acetylenic group, an aromatic group, a carbonyl group, an alkoxyl group, a cyano functional group (C≡N), H, an ether group, an additional ester group, a hydrocarbon group, or any derivative thereof; and $R^3$ is a hydrocarbon group. As used herein, a "hydrocarbon group" may, unless otherwise specifically noted, includes one or more chains of carbon atoms bonded with hydrogen atoms and may be branched, unbranched, noncyclic, and/or cyclic; it may be substituted or unsubstituted (that is, it may or may not contain one or more additional moieties or functional groups (e.g., additional electron withdrawing groups) in place of one or more hydrogen atoms in the hydrocarbon chain); it may be saturated or unsaturated; and/or it may be bonded to at least one other hydrocarbon chain. As used herein, "independently" refers to the notion that the preceding items may be the same or different. As used herein, the term "substituted" refers to one or more of the hydrogen atoms in a hydrocarbon chain being replaced by one or more functional groups. In certain such embodiments, a hydrocarbon chain may be substituted with one or more functional groups selected from the group consisting of an ether, an ester, a hydroxyl, an alkane, an alkene, an alkyne, and any combination thereof.

In certain embodiments, two or more of $R^1$, $R^2$, and $R^3$ may be a $C_1$ to $C_{10}$ hydrocarbon chain and may be bonded together. Furthermore, as used herein, the nomenclature "$C_x$ to $C_y$" refers to the number of carbon atoms in the hydrocarbon chain (here, ranging from x to y carbon atoms). In some embodiments, shorter hydrocarbon chain lengths and/or the inclusion of hydroxyl groups in the hydrocarbon chains may increase the water solubility of the organic ester, among other reasons, to promote solubility of the ester in water and/or the release of the organic acid.

The organic acids released by the organic esters of the present disclosure may be of any suitable chemical structure. Examples of organic acids that may be released by these esters include, but are not limited to methoxyacetic acid, fluoroacetic acid, chloroacetic acid, bromoacetic acid, iodoacetic acid, dichloroacetic acid, trichloroacetic acid, trifluoroacetic acid, nitroacetic acid, cyanoacetic acid, pyruvic acid, oxalic acid, oxaloacetic acid, acrylic acid, propiolic acid, 3-chloroacrylic acid, 3-fluoroacrylic acid, 2-chlorobenzoic acid, 3-chlorobenzoic acid, 4-chlorobenzoic acid, 2-fluorobenzoic acid, 3-fluorobenzoic acid, 4-fluorobenzoic acid, 2-nitrobenzoic acid, 3-nitrobenzoic acid, 4-nitrobenzoic acid, 2,4-dinitrobenzoic acid, maleic acid, fumaric acid, and any combination thereof.

Because of their chemical structures and the presence of one or more electron withdrawing groups, the organic acids released by the organic esters of the present disclosure may exhibit stronger acidity (e.g., lower pKa) than typical organic acids, e.g., corresponding organic acids that lack electron withdrawing groups at that position. In some embodiments, the organic acids released by the organic esters of the present disclosure may have a pKa that is at least 0.5 less than the pKa of the corresponding organic acid that lacks electron withdrawing groups. In some embodiments, the organic acids released by the organic esters of the present disclosure may have a pKa that is at least 1.0 less than the pKa of the corresponding organic acid that lacks electron withdrawing groups. In some embodiments, the organic acids released by the organic esters of the present disclosure may have a pKa that is at least 2.0 less than the pKa of the corresponding organic acid that lacks electron withdrawing groups. In some embodiments, the organic acids released by the organic esters of the present disclosure may have a pKa that is at least 3.5 less than the pKa of the corresponding organic acid that lacks electron withdrawing groups. In some embodiments, the organic acids released by the organic esters of the present disclosure may have a pKa<4.75. In some embodiments, the organic acids released by the organic esters of the present disclosure may have a pKa<3.75. In some embodiments, the organic acids released by the organic esters of the present disclosure may have a pKa<3.0.

In certain embodiments, the organic ester may be present in the treatment fluids of the present disclosure in an amount sufficient to generate and/or release the desired amount of the organic acid. In certain embodiments, the organic ester may be present in the treatment fluid in an amount from about 0.1% to about 50% by volume of the treatment fluid. A person skilled in the art, with the benefit of this disclosure, will appreciate the amount of the organic ester used in the treatment fluid may vary depending upon the application of the treatment fluid as well as the conditions (e.g., temperature, pH) in which the organic ester will be used. As described elsewhere herein, in certain embodiments, the treatment fluids of the present disclosure may be used in acidizing applications and/or dissolving portions of a filter cake. In some such embodiments, the organic ester may be present in the treatment fluid in an amount from about 1% to about 50% by volume of the treatment fluid. In other such embodiments, the organic ester may be present in the treatment fluid in an amount from about 3% to about 40% by volume of the treatment fluid. In yet other such embodiments, the organic ester may be present in the treatment fluid in an amount from about 5% to about 20% by volume of the treatment fluid. In some embodiments, the organic ester may be present in the treatment fluid in a molar ratio of from about 1:1 to about 100:1 based on the molar amount of acid soluble components (e.g., carbonates). In other such embodiments, the organic ester may be present in the treatment fluid in a molar ratio of from about 1:1 to about 50:1 based on the molar amount of acid soluble components.

As described elsewhere herein, in certain embodiments, the treatment fluids of the present disclosure may be used in other applications, including, but not limited to, reducing the viscosity of a viscosified fracturing fluid. A person of skill in the art will recognize, with the benefit of this disclosure, will appreciate the amount of the organic ester used in the treatment fluid for these applications may vary depending upon, for example, the nature of the polymer that has been used to viscosify the fluid (e.g., whether the polymer is natural or synthetic, whether the polymer is crosslinked, etc.) as well as the conditions (e.g., temperature, pH) in which the organic ester will be used. In some such embodiments, the organic ester may be present in the treatment fluid in an amount from about 0.1% to about 10% by volume of the treatment fluid. In other such embodiments, the organic ester may be present in the treatment fluid in an amount from about 0.5% to about 7% by volume of the treatment fluid. In yet other such embodiments, the organic ester may be present in the treatment fluid in an amount from about 1% to about 5% by volume of the treatment fluid. In some embodiments, the organic ester may be present in the treatment fluid in an amount of from about 0.01:1 to about 20:1 by weight of the polymer in the viscosified fluid.

In other such embodiments, the organic ester may be present in the treatment fluid in an amount of from about 0.1:1 to about 10:1 by weight of the polymer in the viscosified fluid. In certain embodiments, the treatment fluids used in the methods and compositions of the present disclosure may include one or more mutual solvents such as polar organic solvents. In such embodiments, the mutual solvent may improve the solubility of the organic ester in aqueous base fluids. Solvents that may be suitable for use in certain embodiments of the present disclosure include alcohols, glycols, glycol ethers, esters, amides, any derivatives thereof, and any combinations thereof. Examples of such solvents include, but are not limited to, methanol, ethanol, isopropanol, n-butanol, iso-butanol, tert-butanol, ethylene glycol, polyethylene glycol, propylene glycol, dipropylene glycol, butanediol, pentanediol, glycerol, polyglycerol, 2-pyrrolidone, N-methyl-2-pyrrolidone, ethylene glycol dimethyl ether, ethylene glycol diethyl ether, ethylene glycol monobutyl ether, diethylene glycol monobutyl ether, polyglycol ethers, any derivatives thereof, and any combinations thereof.

In certain embodiments, the solvent may be present in the treatment fluid in an amount up to about 70% by volume of the treatment fluid. In other embodiments, the solvent may be present in the treatment fluid in an amount from about 1% to about 50% by volume of the treatment fluid. In other embodiments, the solvent may be present in the treatment fluid in an amount from about 2% to about 40% by volume of the treatment fluid. In other embodiments, the solvent may be present in the treatment fluid in an amount from about 5% to about 30% by volume of the treatment fluid.

In certain embodiments, the treatment fluids prepared according to the methods and compositions of the present disclosure optionally may include any number of additional additives. Examples of such additives include, but are not limited to, buffering agents, salts, acids, diverting agents, fluid loss control additives, gas, nitrogen, carbon dioxide, surface modifying agents, tackifying agents, foamers, scale inhibitors, corrosion inhibitors, surfactants, emulsifiers, catalysts, clay stabilizers, shale inhibitors, biocides, friction reducers, antifoam agents, bridging agents, flocculants, $H_2S$ scavengers, $CO_2$ scavengers, oxygen scavengers, lubricants, hydrocarbons, viscosifying/gelling agents, breakers, weighting agents, relative permeability modifiers, resins, wetting agents, coating enhancement agents, filter cake removal agents, antifreeze agents (e.g., ethylene glycol), proppant particles, and the like. A person skilled in the art, with the benefit of this disclosure, will recognize the types of additives that may be included in the fluids of the present disclosure for a particular application.

In certain embodiments, the organic esters used in the methods and compositions of the present disclosure may release an organic acid when exposed to a certain temperature (e.g., in a subterranean formation). In certain embodiments, the organic esters may release an acid in a subterranean formation having a temperature of from about 20° C. (68° F.) to about 232° C. (450° F.). In some embodiments, the organic ester may release an acid in a subterranean formation having a temperature of from about 20° C. (68° F.) to about 177° C. (350° F.). In other embodiments, the organic ester may release an acid in a subterranean formation having a temperature of at least 20° C. (68° F.). In other embodiments, the organic ester may release an organic acid in a subterranean formation having a temperature as low as any of 70, 75, 80, 85, 90, 95, 100, 105, 110, 115, 120, 125, 130, 135, 140, 145, 150, 155, 160, 165, 170, 175, 180, 185, 190, 195, or 200° F. In some embodiments, the organic acids released by the organic esters as disclosed herein may be effective in breaking polymers and/or dissolving carbonates at temperatures of about 204° C. (400° F.) or less, or alternatively, about 149° C. (300° F.) or less, or about 93° C. (200° F.) or less. In some embodiments, the organic acids released by the organic esters as disclosed herein may be effective in breaking polymers and/or dissolving carbonates at temperatures of about 66° C. (150° F.) to about 93° C. (200° F.).

In certain embodiments, the pH of the treatment fluid may decrease after being introduced into the wellbore. In some embodiments, the pH of the treatment fluid may further decrease as time progresses after the introduction of the treatment fluid into the wellbore, for example, as the organic acid is released from the organic ester. In certain embodiments, the pH of the treatment fluid may be about 3 or less after the treatment fluid is introduced into the wellbore. In certain embodiments, the pH of the treatment fluid may be about 3 or less within about 2 hours after the treatment fluid is introduced into the wellbore. In some embodiments, the pH of the treatment fluid may be about 3 or less within about 24 hours after the treatment fluid introduced into the wellbore. In other embodiments, the pH of the treatment fluid may be about 3 or less within about 72 hours after the treatment fluid is introduced into the wellbore. In other embodiments, the pH of the treatment fluid may be about 3 or less within about 5 days after the treatment fluid is introduced into the wellbore.

In some embodiments, the methods and compositions of the present disclosure may be used during or in conjunction with any subterranean operation. For example, the methods and compositions of the present disclosure may be used in the course of and/or after drilling operations in which a wellbore has been drilled to penetrate a subterranean formation. In certain embodiments, the treatment fluid of the present disclosure may be introduced into and/or circulated in the wellbore after drilling to contact one or more polymers (e.g., synthetic polymers or biopolymers) in the wellbore and/or subterranean formation, among other purposes, to at least partially break one or more crosslinks or other chemical bonds (e.g., in the backbone) in that polymer. The polymer(s) may include one or more synthetic polymers and/or biopolymers, any of which may be, in some embodiments, crosslinked with a crosslinking agent. Examples of suitable biopolymers include, but are not limited to, xanthan gum, scleroglucan gum, diutan gum, guar gum, Whelan gum, and derivatives thereof, such as hydroxypropyl guar and carboxymethylhydroxypropyl guar, cellulose derivatives, such as hydroxyethylcellulose, carboxymethylcellulose, polyanionic cellulose, and starch and its derivatives, such as pregelatinized starch and crosslinked starch, and any combination thereof. Examples of suitable synthetic polymers include, but are not limited to, homopolymers or copolymers of acrylamide, methacrylamide, N,N-dimethylacrylamide, N-substituted acrylamide, acrylic acid, methacrylic acid, acrylate esters, methacrylate esters, 2-acrylamido-2-propanesulfonic acid (AMPS) and salts, vinylsulfonic acid and salts, N-vinylpyrrolidone, N-vinyllactam, and their derivatives, such as crosslinked synthetic polymers, and any combination thereof. In certain embodiments, the treatment fluid of the present disclosure may be introduced into and/or circulated in the wellbore after drilling to contact a biopolymer in the wellbore and/or subterranean formation, among other purposes, to at least partially degrade and/or remove one or more portions of the polymer. In certain embodiments, this may be accomplished using the pumping system and equipment used to circulate the treatment fluid in the wellbore.

In another embodiment, the treatment fluids of the present disclosure may be introduced into and/or circulated in the wellbore after drilling to contact a filter cake deposited on the walls of the wellbore and/or in the subterranean formation, among other purposes, to at least partially degrade and/or remove one or more portions of the filter cake. In another embodiment, the treatment fluids of the present disclosure may be used just prior to placing cement and/or casing in the wellbore, among other reasons, in order to remove a filter cake from the wellbore. In such embodiments, the treatment fluids of the present disclosure may be continuously pumped down the casing or pipe and upwardly through an annulus in the wellbore in contact with the filter cake as a pre-flush just prior to introducing a spacer fluid and a cement slurry into the annulus. In some embodiments, the quantity of the treatment fluids of the present disclosure pumped through the annulus prior to when the cement slurry is introduced therein (as well as other compositions used to dissolve components of the filter cake) may be a predetermined quantity calculated to remove substantially all of the filter cake, which may provide for a more successful and efficient cementing job.

In other embodiments, the treatment fluids of the present disclosure may be used in the course of a stimulation treatment. In such embodiments, the treatment fluids of the present disclosure may be introduced into a portion of a subterranean formation where it may be allowed to contact at least a portion of the subterranean formation and at least partially dissolve carbonate minerals therein so as to create one or more voids in the subterranean formation. Introduction of the treatment fluid may, in certain embodiments, be carried out at or above a pressure sufficient to create or enhance one or more fractures within the subterranean formation. In other embodiments, introduction of the treatment fluid may be carried out at a pressure below that which would create or enhance one or more fractures within the subterranean formation.

In other embodiments, the treatment fluid of the present disclosure may be used in the course of a fracturing treatment. In certain embodiments, the organic esters of the present disclosure may be included in a fracturing fluid that is introduced into a portion of a subterranean formation at or above a pressure sufficient to create or enhance one or more fractures within the subterranean formation. In such embodiments, the organic ester may release an organic acid that interacts with a polymer in the fracturing fluid to at least partially reduce the viscosity of the fluid. In some embodiments, the fracturing fluid may include proppants, and the proppants may be deposited within the subterranean formation, for example, within one or more fracture, as the viscosity of the fracturing fluid is at least partially reduced.

Other suitable subterranean operations in which the methods and/or compositions of the present disclosure may be used include, but are not limited to, pre-flush treatments, after-flush treatments, hydraulic fracturing treatments, sand control treatments (e.g., gravel packing), "frac-pack" treatments, wellbore clean-out treatments, stuck pipe treatments, filter cake removal treatments, skin remediation treatments, scale squeeze treatments, and other operations where a treatment fluid may be useful. In certain embodiments, the methods and compositions of the present disclosure may also be used in cleaning operations or treatments conducted at the surface that are used to clean or prepare equipment or other components that are subsequently used in subterranean operations.

The treatment fluids of the present disclosure may be prepared using any suitable method and/or equipment (e.g., blenders, mixers, stirrers, etc.) known in the art at any time prior to their use. The treatment fluids may be prepared at least in part at a well site or at an offsite location. In certain embodiments, the organic ester and/or other components of the treatment fluid may be metered directly into a base fluid to form a treatment fluid. In certain embodiments, the base fluid may be mixed with the organic ester and/or other components of the treatment fluid at a well site where the operation or treatment is conducted, either by batch mixing or continuous ("on-the-fly") mixing. The term "on-the-fly" is used herein to include methods of combining two or more components wherein a flowing stream of one element is continuously introduced into a flowing stream of another component so that the streams are combined and mixed while continuing to flow as a single stream as part of the on-going treatment. Such mixing can also be described as "real-time" mixing. In other embodiments, the treatment fluids of the present disclosure may be prepared, either in whole or in part, at an offsite location and transported to the site where the treatment or operation is conducted. In introducing a treatment fluid of the present disclosure into a portion of a subterranean formation, the components of the treatment fluid may be mixed together at the surface and introduced into the formation together, or one or more components may be introduced into the formation at the surface separately from other components such that the components mix or intermingle in a portion of the formation to form a treatment fluid. In either such case, the treatment fluid is deemed to be introduced into at least a portion of the subterranean formation for purposes of the present disclosure.

Certain embodiments of the methods and compositions disclosed herein may directly or indirectly affect one or more components or pieces of equipment associated with the preparation, delivery, recapture, recycling, reuse, and/or disposal of the disclosed compositions. For example, with reference to FIG. 1, the disclosed methods and compositions may directly or indirectly affect one or more components or pieces of equipment associated with an example of a well and treatment system, according to one or more embodiments. Referring now to FIG. 1, a well 160 is shown during an operation according to certain embodiments of the present disclosure in a portion of a subterranean formation of interest 110 surrounding a wellbore 120. The subterranean formation of interest 110 may include acid-soluble components. The subterranean formation may be a carbonate formation, sandstone formation, mixed carbonate-sandstone formation, or any other subterranean formation suitable for an acidizing treatment. The wellbore 120 extends from the surface 130 and through a portion of the subterranean formation 110 surrounding the horizontal portion of the wellbore. Although shown as vertical deviating to horizontal, the wellbore 120 may include horizontal, vertical, slant, curved, and other types of wellbore geometries and orientations, and the treatment may be applied to a subterranean zone surrounding any portion of the wellbore. The wellbore 120 can include a casing 140 that is cemented or otherwise secured to the wellbore wall. The wellbore 120 can be uncased or include uncased sections. Perforations can be formed in the casing 140 to allow fluids and/or other materials to flow into the subterranean formation 110. In cased wells, perforations can be formed using shape charges, a perforating gun, hydro-jetting and/or other tools.

The well is shown with a work string 170 depending from the surface 130 into the wellbore 120. A pump and blender system 150 is coupled to the work string 170 to pump the treatment fluid 100 into the wellbore 120. The working string 170 may include coiled tubing, jointed pipe, and/or other structures that allow fluid to flow into the wellbore 120. The working string 170 can include flow control devices, bypass valves, ports, and or other tools or well devices that control a flow of fluid from the interior of the working string 170 into the subterranean zone 110. For example, the working string 170 may include ports adjacent the wellbore wall to communicate the treatment fluid 100 directly into the subterranean formation 110, and/or the working string 170 may include ports that are spaced apart from the wellbore wall to communicate the treatment fluid 100 into an annulus in the wellbore 120 between the working string 170 and the wellbore wall.

The working string 170 and/or the wellbore 120 may include one or more sets of packers 180 that seal the annulus between the working string 170 and wellbore 120 and/or a downhole portion of the wellbore 120 to define an interval of the wellbore 120 into which particulate materials and/or treatment fluids will be pumped.

As shown, the wellbore 120 penetrates a portion 110 of the subterranean formation, which may include a hydrocarbon-bearing reservoir. In some cases, a treatment fluid 100 (e.g., a treatment fluid of the present disclosure) may be pumped through the working string 170 and into the portion 110 of the formation. In some embodiments, an acid in the treatment fluid 100 (e.g., an organic acid released by the organic esters of the present disclosure) may react with one or more acid soluble materials in the formation to create wormholes 195 in the portion 110 of the subterranean formation.

In some embodiments, the injection of the treatment fluid 100 may be monitored at the well site. In some embodiments, wellbore conditions may be monitored during injection. Examples of wellbore conditions that may be suitable for use in the methods of the present disclosure include, but are not limited to temperature, pressure, skin, fluid distribution, flow rate, pH, any physical or chemical property of the formation or formation fluids, and any combination thereof. For example, in certain embodiments, the injection rate could be updated with the methods of the present disclosure during injection using conditions such as fluid distribution and wellbore pressure.

In some embodiments, wellbore conditions of the present disclosure could be measured by sensors. In certain embodiments, sensors could be located in the wellbore. For purposes of this disclosure, the term "sensors" is understood to include sources (to emit and/or transmit energy and/or signals), receivers (to receive and/or detect energy and/or signals), and transducers (to operate as a source and/or receiver). In certain embodiments, information from the sensors may be fed into a system or tool that can determine an injection rate or rate profile according to the methods of the present disclosure.

It is also to be recognized that the disclosed treatment fluids may directly or indirectly affect the various downhole equipment and tools that may come into contact with the treatment fluids during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above in FIG. 1.

EXAMPLE

To demonstrate the effectiveness of the organic esters of the present disclosure, three organic acids (formic acid, pyruvic acid, and trichloroacetic acid) were tested for their ability to break a crosslinked starch at 100° F. and 150° F. These three acids have increased acidity (pKa) in the order of: formic acid<pyruvic acid<trichloroacetic acid.

Three solutions of starch crosslinked with epichlorohydrin in 10 pounds per gallon of a sodium bromide brine (2.32 wt %) were mixed for 30 minutes. A cloudy solution was formed because the crosslinked starch is not completely soluble in the sodium bromide brine. To each crosslinked starch solution was added 0.0189 mol sodium carbonate to simulate the effect of the presence of a calcium carbonate particle such as a bridging agent. One of the acids was added into each crosslinked starch solution, such that some of the acids were neutralized by the sodium carbonate. The pH of each solution was measured after all the sodium carbonate is neutralized (generally within 5 minutes), which is reported in Table 1 below. As shown in Table 1, with the same molar amount of acid and sodium carbonate, the organic acids of the present disclosure with lower pKa resulted in solutions having much lower pH, which would help break the crosslinked starch.

TABLE 1

| Sample # | Crosslinked starch solution, mL | Formic acid, mol | Pyruvic acid, mol | Trichloroacetic acid, mol | $Na_2CO_3$, mol | pH, measured |
|---|---|---|---|---|---|---|
| #1 | 48.8 | 0.163 | — | — | 0.0189 | 2.48 |
| #2 | 43.5 | — | 0.163 | — | 0.0189 | 0.94 |
| #3 | 38.7 | — | — | 0.135 | 0.0189 | −0.32 |

Each sample was divided in half and allowed to age at temperatures of 100° F. and 150° F., respectively, for a total of 3 days. Once the crosslinked starch is broken, it becomes soluble in the brine and the solution turns clear. Table 2 reports the appearance of the three samples after aging for 1 day and 3 days at 100° F. and 150° F. As shown in Table 2, the formic acid was still unable to break the crosslinked starch completely at 150° F. after 3 days (Sample #1). The stronger pyruvic acid had substantially broken the crosslinked starch completely at 150° F. after 3 day (Sample #2). Trichloroacetic acid, the strongest acid of all three, substantially broke the crosslinked starch at 150° F. after 1 day, and had broken the crosslinked starch somewhat after 3 days even at 100° F. (Sample #3).

TABLE 2

| Sample # | Initial | 100° F. After 1 day | 100° F. After 3 days | 150° F. After 1 day | 150° F. After 3 days |
|---|---|---|---|---|---|
| #1 | Cloudy | Cloudy | Cloudy | Cloudy | Hazy |
| #2 | Cloudy | Cloudy | Cloudy | Hazy | Clear |
| #3 | Cloudy | Cloudy | Hazy | Clear | Clear |

An embodiment of the present disclosure is a method that includes: providing a treatment fluid including an aqueous base fluid and at least one organic ester that includes at least one electron withdrawing group selected from the group consisting of F, Cl, Br, I, $NO_2$, a vinyl group, an acetylenic group, an aromatic group, a carbonyl group, an alkoxyl group, a cyano functional group (C≡N), and any derivative thereof; and introducing the treatment fluid into at least a portion of a wellbore penetrating at least a portion of a subterranean formation.

In one or more embodiments described in the preceding paragraph, the at least one organic ester has one of the following structural formulas:

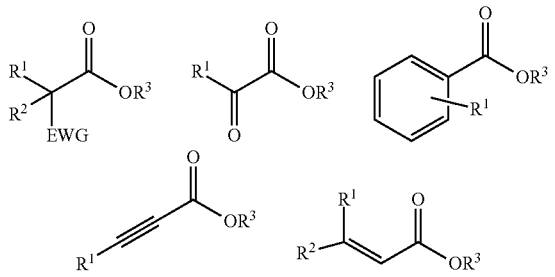

wherein EWG is selected from the group consisting of F, Cl, Br, I, $NO_2$, a vinyl group, an acetylenic group, an aromatic group, a carbonyl group, an alkoxyl group, a cyano functional group (C≡N), and any derivative thereof, $R^1$ and $R^2$ are each independently selected from the group consisting of F, Cl, Br, I, $NO_2$, a vinyl group, an acetylenic group, an aromatic group, a carbonyl group, an alkoxyl group, a cyano functional group, hydrogen, an ether group, an additional ester group, a hydrocarbon group, and any derivative thereof, and $R^3$ is a hydrocarbon group. In one or more embodiments described above, the method further includes allowing the organic ester to release at least one organic acid in the subterranean formation. In one or more embodiments described above, the organic acid has a pKa<3.75. In one or more embodiments described above, the organic acid is selected from the group consisting of: methoxyacetic acid, fluoroacetic acid, chloroacetic acid, bromoacetic acid, iodoacetic acid, dichloroacetic acid, trichloroacetic acid, trifluoroacetic acid, nitroacetic acid, cyanoacetic acid, pyruvic acid, oxalic acid, oxaloacetic acid, propiolic acid, 3-chloroacrylic acid, 3-fluoroacrylic acid, 2-chlorobenzoic acid, 3-chlorobenzoic acid, 4-chlorobenzoic acid, 2-fluorobenzoic acid, 3-fluorobenzoic acid, 4-fluorobenzoic acid, 2-nitrobenzoic acid, 3-nitrobenzoic acid, 4-nitrobenzoic acid, 2,4-dinitrobenzoic acid, maleic acid, fumaric acid, and any combination thereof, and any combination thereof. In one or more embodiments described above, the method further includes allowing the organic acid to acidize the portion of the subterranean formation or damage in the subterranean formation. In one or more embodiments described above, the method further includes contacting at least a portion of a polymer or a filter cake located in the subterranean formation with the organic acid, whereby the portion of the polymer or the filter cake at least partially degrades. In one or more embodiments described above, the portion of the subterranean formation has a temperature of about 450° F. or less.

Another embodiment of the present disclosure is a method that includes: providing a treatment fluid including an aqueous base fluid, at least one polymer, and at least one organic ester that includes at least one electron withdrawing group selected from the group consisting of F, Cl, Br, I, $NO_2$, a vinyl group, an acetylenic group, an aromatic group, a carbonyl group, an alkoxyl group, a cyano functional group (C≡N), and any derivative thereof; introducing the treatment fluid in a wellbore penetrating at least a portion of a subterranean formation at or above a pressure sufficient to create or enhance one or more fractures within the subterranean formation; and allowing the organic ester to generate an organic acid.

In one or more embodiments described in the preceding paragraph, the at least one organic ester has one of the following structural formulas:

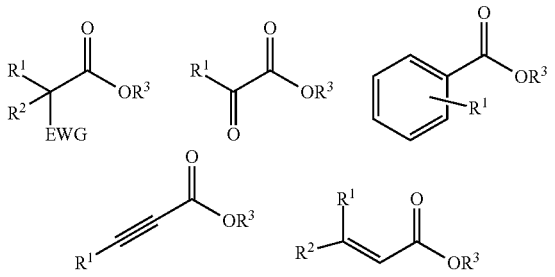

wherein EWG is selected from the group consisting of F, Cl, Br, I, $NO_2$, a vinyl group, an acetylenic group, an aromatic group, a carbonyl group, an alkoxyl group, a cyano functional group (C≡N), and any derivative thereof, $R^1$ and $R^2$ are each independently selected from the group consisting of F, Cl, Br, I, $NO_2$, a vinyl group, an acetylenic group, an aromatic group, a carbonyl group, an alkoxyl group, a cyano functional group, hydrogen, an ether group, an additional ester group, a hydrocarbon group, and any derivative thereof, and $R^3$ is a hydrocarbon group. In one or more embodiments described above, the polymer includes a biopolymer. In one or more embodiments described above, the portion of the subterranean formation has a temperature of about 450° F. or less. In one or more embodiments described above, the method further includes allowing the organic acid to interact with the polymer after the treatment fluid has been introduced into the well bore, whereby a viscosity of the treatment fluid is reduced. In one or more embodiments described above, the polymer includes a crosslinked polymer. In one or more embodiments described above, a portion of the organic acid breaks one or more crosslinks in the crosslinked polymer.

Another embodiment of the present disclosure is a method that includes: providing a treatment fluid including an aqueous base fluid and at least one organic ester that includes at least one electron withdrawing group selected from the group consisting of F, Cl, Br, I, $NO_2$, a vinyl group, an acetylenic group, an aromatic group, a carbonyl group, an alkoxyl group, a cyano functional group (C≡N), and any derivative thereof; introducing the treatment fluid into at least a portion of a wellbore penetrating at least a portion of a subterranean formation; allowing the organic ester to generate an organic acid; and contacting at least a portion of a filter cake located in the portion of the subterranean formation with the organic acid, wherein the organic acid degrades at least a portion of the filter cake.

In one or more embodiments described in the preceding paragraph, the at least one organic ester has one of the following structural formulas:

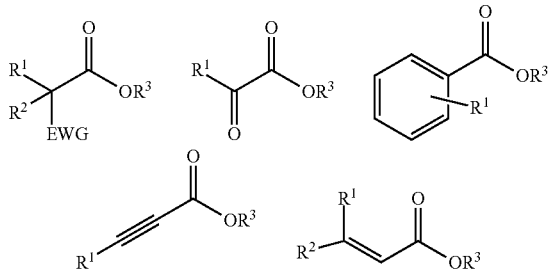

wherein EWG is selected from the group consisting of F, Cl, Br, I, $NO_2$, a vinyl group, an acetylenic group, an aromatic group, a carbonyl group, an alkoxyl group, a cyano functional group (C≡N), and any derivative thereof, $R^1$ and $R^2$ are each independently selected from the group consisting of F, Cl, Br, I, $NO_2$, a vinyl group, an acetylenic group, an aromatic group, a carbonyl group, an alkoxyl group, a cyano functional group, hydrogen, an ether group, an additional ester group, a hydrocarbon group, and any derivative thereof, and $R^3$ is a hydrocarbon group. In one or more embodiments described above, the portion of the subterranean formation has a temperature of about 450° F. or less. In one or more embodiments described above, the filter cake includes at least one polymer, and the organic acid degrades at least a portion of the polymer in the filter cake. In one or more embodiments described above, the at least one polymer is selected from the group consisting of: a biopolymer; a synthetic polymer; and any combination thereof.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A method comprising:

providing a treatment fluid comprising an aqueous base fluid and at least one organic ester having the following structural formula:

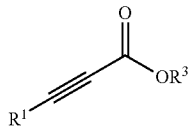

wherein the structural formula comprises an alkynyl group and $R_1$ and $R_3$ are alkyl groups; and introducing the treatment fluid into at least a portion of a wellbore penetrating at least a portion of a subterranean formation.

2. The method of claim 1, further comprising allowing the organic ester to release at least one organic acid in the subterranean formation.

3. The method of claim 2, wherein the organic acid has a pKa<3.75.

4. The method of claim 2, wherein the organic acid comprises propiolic acid or substituted propiolic acid, wherein Ri comprises one alkyl group selected from a group of alkyl groups consisting of methyl, ethyl, and propyl group.

5. The method of claim 2, further comprising contacting at least a portion of a polymer or a filter cake located in the subterranean formation with the organic acid, whereby the portion of the polymer or the filter cake at least partially degrades.

6. The method of claim 1 wherein the portion of the subterranean formation has a temperature of from about 68° F. to about 450° F.

7. The method of claim 1 wherein the portion of the subterranean formation has a temperature of from about 68° F. to about 350° F.

8. The method of claim 1 wherein the portion of the subterranean formation has a temperature of from about 68° F. to about 300° F.

9. The method of claim 1 wherein the portion of the subterranean formation has a temperature of from about 68° F. to about 200° F.

10. The method of claim 1 wherein the portion of the subterranean formation has a temperature of from about 68° F. to about 175° F.

11. The method of claim 1 wherein the portion of the subterranean formation has a temperature of from about 68° F. to about 150°.

12. The method of claim 1, wherein a pH of the treatment fluid is 3 or less after the treatment fluid is introduced into the wellbore.

13. The method of claim 1, wherein a pH of the treatment fluid is 3 or less within 2 hours after the treatment fluid is introduced into the wellbore.

14. The method of claim 1, wherein a pH of the treatment fluid is 3 or less within 24 hours after the treatment fluid is introduced into the wellbore.

15. The method of claim 1, wherein a pH of the treatment fluid is 3 or less within 72 hours after the treatment fluid is introduced into the wellbore.

16. A method comprising:

providing a treatment fluid comprising an aqueous base fluid and at least one organic ester having the following structural formula:

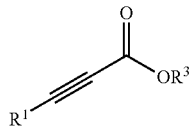

wherein the structural formula comprises alkynyl group and $R_1$ and $R_3$ are alkyl groups;

introducing the treatment fluid into at least a portion of a wellbore penetrating at least a portion of a subterranean formation;

allowing the organic ester to generate an organic acid; and contacting at least a portion of a filter cake located in the portion of the subterranean formation with the organic acid, wherein the organic acid degrades at least a portion of the filter cake.

17. The method of claim 16, wherein the organic acid comprises propiolic acid or substituted propiolic acid, wherein $R_1$ comprises one alkyl group selected from a group of alkyl groups consisting of methyl, ethyl, and propyl group.

18. The method of claim 16 wherein the portion of the subterranean formation has a temperature of from about 68° F. to about 450° F.

19. The method of claim 16, wherein the filter cake comprises at least one polymer, and the organic acid degrades at least a portion of the polymer in the filter cake.

20. The method of claim 19, wherein the at least one polymer is selected from the group consisting of: a biopolymer; a synthetic polymer; and any combination thereof.

* * * * *